US009188389B2

(12) United States Patent
Ren et al.

(10) Patent No.: US 9,188,389 B2
(45) Date of Patent: Nov. 17, 2015

(54) SYSTEMS AND METHODS FOR DEWATERING MINE TAILINGS

(71) Applicants: Wei Ren, Missouri City, TX (US); Ken N. Sury, Calgary (CA); David C. Rennard, Houston, TX (US); Shahram Yazdanpanah, Calgary (CA)

(72) Inventors: Wei Ren, Missouri City, TX (US); Ken N. Sury, Calgary (CA); David C. Rennard, Houston, TX (US); Shahram Yazdanpanah, Calgary (CA)

(73) Assignee: ExxonMobil Upstream Research Company, Houston, TX (US)

( * ) Notice: Subject to any disclaimer, the term of this patent is extended or adjusted under 35 U.S.C. 154(b) by 104 days.

(21) Appl. No.: 14/206,546

(22) Filed: Mar. 12, 2014

(65) Prior Publication Data

US 2014/0305001 A1 Oct. 16, 2014

(30) Foreign Application Priority Data

Apr. 10, 2013 (CA) ..... 2812273

(51) Int. Cl.
*F26B 3/08* (2006.01)
*F26B 5/00* (2006.01)
*F26B 17/12* (2006.01)

(52) U.S. Cl.
CPC . *F26B 5/00* (2013.01); *F26B 17/12* (2013.01); *F26B 2200/18* (2013.01)

(58) Field of Classification Search
CPC ..... F26B 3/00; F26B 3/08; F26B 11/00; F26B 21/00; F26B 21/06; C10G 1/00; C10G 1/04; C02F 1/00; C02F 1/33; C02F 103/10
USPC ..... 34/353, 397, 413, 497, 95.1, 236; 208/390, 391; 210/723, 767; 110/234, 110/252
See application file for complete search history.

(56) References Cited

U.S. PATENT DOCUMENTS

| | | | | | |
|---|---|---|---|---|---|
| 4,580,925 | A | * | 4/1986 | Matich et al. | 588/250 |
| 4,690,971 | A | | 9/1987 | Flesher et al. | 524/555 |
| 4,880,858 | A | | 11/1989 | Farrar et al. | 524/60 |
| 5,258,123 | A | | 11/1993 | Huang et al. | 210/663 |
| 5,355,594 | A | * | 10/1994 | Hwang | 34/356 |
| 5,391,597 | A | | 2/1995 | Davies et al. | 524/2 |
| 5,413,433 | A | | 5/1995 | Davies | 405/129 |
| 5,527,382 | A | * | 6/1996 | Pincheira Alvarez et al. | 75/712 |
| 5,788,867 | A | | 8/1998 | Pearson | 210/733 |

(Continued)

FOREIGN PATENT DOCUMENTS

| | | | | |
|---|---|---|---|---|
| CA | 2195448 | | 2/1996 | C02F 11/00 |
| CA | 2173533 | A1 * | 10/1997 | |

(Continued)

*Primary Examiner* — Stephen M Gravini
(74) *Attorney, Agent, or Firm* — ExxonMobil Upstream Research Law Department

(57) ABSTRACT

Systems and methods for dewatering mine tailings. The systems and methods include distributing a slurry of high permeability material on a sloped surface to define a high permeability layer and subsequently distributing a slurry of low permeability mine tailings on the high permeability layer to define a low permeability layer that is vertically above and in contact with the high permeability layer. The sloped surface defines a non-zero surface grade, and natural slopes of both the slurry of high permeability material and the slurry of low permeability mine tailings are within a threshold grade difference of the surface grade. In some embodiments, the systems and methods may include augmenting the slurry of high permeability material and/or augmenting the slurry of low permeability mine tailings to adjust the natural slope thereof.

34 Claims, 4 Drawing Sheets

(56) References Cited

U.S. PATENT DOCUMENTS

| | | | | |
|---|---|---|---|---|
| 5,807,489 | A | 9/1998 | Farinato et al. | 210/734 |
| 6,168,352 | B1 * | 1/2001 | Chen et al. | 405/266 |
| 6,262,168 | B1 | 7/2001 | Huang et al. | 524/521 |
| 6,944,967 | B1 * | 9/2005 | Staples | 34/183 |
| 7,340,845 | B2 * | 3/2008 | Kneebone | 34/60 |
| 7,754,087 | B2 | 7/2010 | Whittaker et al. | 210/727 |
| 7,901,583 | B2 | 3/2011 | McColl et al. | 210/710 |
| 7,973,095 | B2 | 7/2011 | Herth et al. | 522/4 |
| 7,984,566 | B2 * | 7/2011 | Staples | 34/90 |
| 8,006,406 | B2 * | 8/2011 | Dingee, IV | 34/371 |
| 2007/0267355 | A1 | 11/2007 | Jones et al. | 210/748 |
| 2010/0193618 | A1 * | 8/2010 | Lewis-Gray | 241/77 |
| 2011/0011769 | A1 * | 1/2011 | Sutton et al. | 208/45 |
| 2011/0188935 | A1 | 8/2011 | McColl et al. | 405/74 |
| 2011/0297381 | A1 | 12/2011 | Code | 166/307 |
| 2012/0138541 | A1 * | 6/2012 | Rennard et al. | 210/723 |
| 2012/0152534 | A1 * | 6/2012 | Troshko et al. | 166/268 |
| 2012/0160781 | A1 | 6/2012 | D'Hollander | 210/767 |
| 2012/0313038 | A1 | 12/2012 | Laros et al. | 252/194 |
| 2013/0105179 | A1 * | 5/2013 | Lieberman | 166/402 |
| 2014/0305000 | A1 * | 10/2014 | Ren et al. | 34/353 |
| 2014/0305001 | A1 * | 10/2014 | Ren et al. | 34/397 |
| 2014/0305873 | A1 * | 10/2014 | Ren et al. | 210/675 |
| 2015/0034530 | A1 * | 2/2015 | Speirs et al. | 208/390 |

FOREIGN PATENT DOCUMENTS

| | | | | |
|---|---|---|---|---|
| CA | 2651440 | | 11/2007 | B09B 3/00 |
| CA | 2407869 | | 1/2010 | B09B 1/00 |
| CA | 2515581 | | 7/2011 | C02F 11/00 |
| EP | 184720 | A1 * | 6/1986 | E21C 41/06 |
| EP | 0195550 | | 4/1989 | B05D 7/00 |
| EP | 0388108 | | 9/1990 | B09B 3/00 |
| EP | WO99/46207 | | 9/1999 | C02F 1/56 |
| GB | 2142065 | A * | 1/1985 | E21F 15/00 |
| WO | WO96/05146 | | 2/1996 | C02F 11/00 |
| WO | WO01/92167 | | 12/2001 | B09B 3/00 |
| WO | WO2004/060819 | | 7/2004 | C02F 11/00 |
| WO | WO 2010100631 | A2 * | 9/2010 | C02F 1/76 |

* cited by examiner

SYSTEMS AND METHODS FOR DEWATERING MINE TAILINGS

CROSS-REFERENCE TO RELATED APPLICATIONS

This application claims priority from Canadian Patent Application No. 2,812,273 filed Apr. 10, 2013 entitled SYSTEMS AND METHODS FOR DEWATERING MINE TAILINGS, the entirety of which are incorporated by reference herein.

FIELD OF THE DISCLOSURE

The present disclosure is directed generally to systems and methods for dewatering mine tailings and more specifically to systems and methods that utilize a sloped surface that supports interleaved, or stacked, high and low permeability layers to dewater the low permeability layers.

BACKGROUND OF THE DISCLOSURE

Mining operations, including mining operations that remove bitumen from oil sands, generate a waste stream that may be referred to generally as mine tailings. These mine tailings often may include a significant quantity of water and may be stored in a storage facility, or structure, such as an enclosure, or pond. Over time, particles within the stored mine tailings may settle, producing a relatively stable suspension of the particles in the water that may have a solids content of approximately 30 wt %. This suspension may be referred to herein as mature fine tailings (MFT) and has a very low shear strength. Thus, the MFT cannot be built upon and vegetation often may not grow thereon.

Because of the long dewatering time for the MFT and the high rate at which mine tailings may be generated, large volumes of mine tailings have been, and continue to be, generated in various parts of the world. Environmental concerns, space constraints, and/or government regulations may dictate that these mine tailings be processed to a more stable form, thereby permitting reclamation of the storage facility, revegetation of the mine tailings, and/or beneficial use of the storage facility. As an illustrative, non-exclusive example, Canadian Directive 74 requires that stored mine tailings be processed such that they have a shear strength of at least 5 kilopascals (kPa) within one year of storage and a shear strength of at least 10 kPa within 5 years of storage. Meeting this directive, for example, may require dewatering of the stored mine tailings at a rate that is significantly higher than the dewatering rates that are experienced when the mine tailings are simply placed in the storage facility and allowed to dewater naturally.

Several technologies have been developed that may increase the dewatering rate of the stored mine tailings; however, these technologies often are costly to implement, require large amounts of space, and/or are ineffective at reaching a target shear strength within a desired period of time, such as to keep up with the rate at which additional mine tailings are being generated. As an illustrative, non-exclusive example, mine tailings may be flocculated to increase a solids content thereof and then spread in very thin layers to permit additional dewatering. However, the allowable thickness of the layers, the large volumes of mine tailings that may be generated, and the time needed to dewater each layer dictate that these sloped beaches must cover very large areas, thereby creating additional space constraints and/or environmental impacts. Thus, there exists a need for improved systems and methods for dewatering mine tailings.

SUMMARY OF THE DISCLOSURE

Systems and methods for dewatering mine tailings. The systems and methods include distributing a slurry of high permeability material on a sloped surface to define a high permeability layer and subsequently distributing a slurry of low permeability mine tailings on the high permeability layer to define a low permeability layer that is vertically above and in contact with the high permeability layer. The sloped surface defines a non-zero surface grade, and natural slopes of both the slurry of high permeability material and the slurry of low permeability mine tailings are within a threshold grade difference of the surface grade.

In some embodiments, the slurry of the high permeability material and the slurry of the low permeability mine tailings are placed hydraulically on the sloped surface, such as by flowing thereonto. In some embodiments, the systems and methods include repeating the distributing the slurry of high permeability material and repeating the distributing the slurry of low permeability mine tailings to define a plurality of interleaved, or stacked, low and high permeability layers.

In some embodiments, the systems and methods include waiting at least a threshold dewatering time subsequent to defining a respective low permeability layer and prior to distributing a respective slurry of high permeability material thereabove. The waiting may include waiting to prevent, or decrease a potential for, damage to the respective low permeability layer due to distribution of the respective slurry of high permeability material thereabove.

However, the systems and methods according to the present disclosure may define the high permeability layer and the low permeability layer such that the threshold dewatering time may be significantly less than a corresponding threshold dewatering time for a comparable system and/or method that does not define the high and low permeability layers as disclosed herein. Thus, a rate at which the high and low permeability layers may be formed (or a rate at which the low permeability mine tailings may be dewatered) may be significantly higher for the systems and methods according to the present disclosure when compared to the comparable systems and/or methods.

In some embodiments, the systems and methods include decreasing a kinetic energy of the respective slurry of high permeability material prior to distributing the respective slurry of high permeability material on the respective low permeability layer. In some embodiments, the systems and methods include adjusting the natural slope of the slurry of high permeability material and/or natural slope of the slurry of low permeability mine tailings. In some embodiments, the adjusting includes combining one or more additives with one or more of the slurries to adjust, or augment, (i.e., increase or decrease) the natural slope thereof.

DETAILED DESCRIPTION AND BEST MODE OF THE DISCLOSURE

FIGS. 1-5 provide illustrative, non-exclusive examples of mine tailings dewatering sites 100 according to the present disclosure and/or to mining operations 20 that may include and/or utilize dewatering sites 100. Elements that serve a similar, or at least substantially similar, purpose are labeled with like numbers in each of FIGS. 1-5, and these elements may not be discussed in detail herein with reference to each of FIGS. 1-5. Similarly, all elements may not be labeled in each of FIGS. 1-5, but reference numbers associated therewith may be utilized herein for consistency. In general, elements that are likely to be included in a given embodiment are illustrated in solid lines, while elements that are optional to a given embodiment are illustrated in dashed lines. However, elements that are shown in solid lines are not essential to all embodiments, and an element shown in solid lines may be omitted from a particular embodiment without departing from the scope of the present disclosure.

Figure 1:
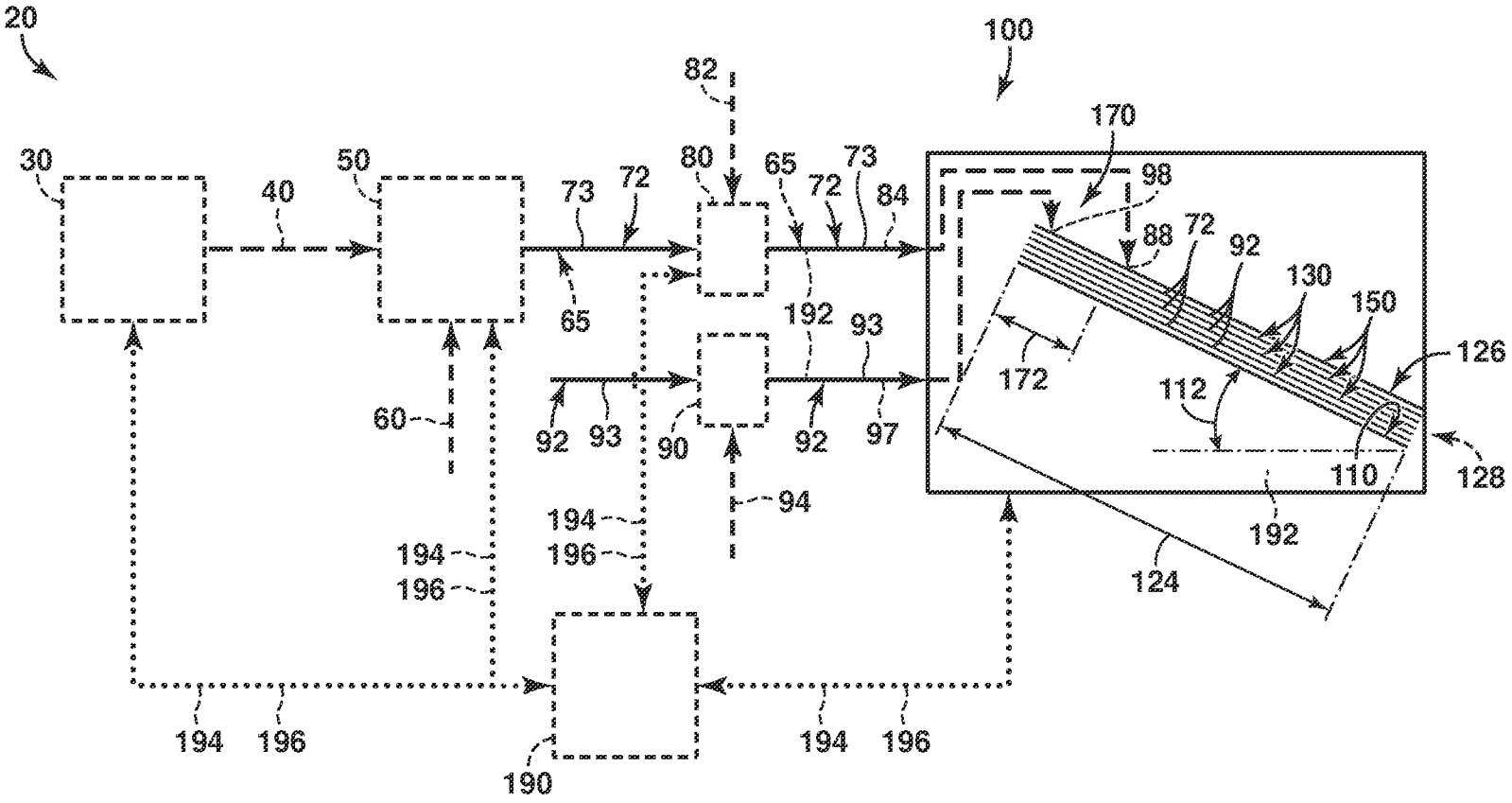
FIG. 1 is a schematic representation of illustrative, non-exclusive examples of a mine tailings dewatering site according to the present disclosure that may be utilized with and/or included in a mining operation.

FIG. 1 is a schematic representation of illustrative, non-exclusive examples of a mine tailings dewatering site 100 according to the present disclosure that may be utilized with and/or included in a mining operation 20. Mine tailings dewatering site 100 includes a sloped surface 110 that defines a non-zero surface grade 112. The sloped surface supports a plurality of spaced-apart high permeability layers 130, which are formed from a high-permeability material 92, are supported by sloped surface 110, and are parallel, or at least substantially parallel, to the sloped surface. The sloped surface also supports a plurality of low permeability layers 150, which are formed from low permeability mine tailings 72, are supported by the sloped surface, and are parallel, or at least substantially parallel, to the sloped surface. In addition, and as illustrated in more detail in FIG. 5, at least one low permeability layer 150 is located between and physically separates each high permeability layer 130 from a remainder of the high permeability layers, and/or at least one high permeability layer is located between and physically separates each low permeability layer 130 from a remainder of the low permeability layers. Accordingly, the sloped surface may be described as supporting a plurality of alternating, stacked, and/or interleaved layers of high permeability material and low permeability mine tailings.

The sequential, or interleaved, layering, or stacking, of high permeability layers 130 and low permeability layers 150 on sloped surface 110 within mine tailings dewatering site 100 may permit efficient dewatering of low permeability mine tailings 72, especially as compared to conventional dewatering systems and procedures. As an illustrative, non-exclusive example, high permeability layers 150 may provide a fluid conduit that may convey a fluid, such as water, away from and/or out of low permeability mine tailings 72, thereby increasing a dewatering rate thereof. As another illustrative, non-exclusive example, sloped surface 110 may permit efficient draining of the fluid from the low permeability mine tailings and/or from the high permeability layers under the influence of gravity, thereby further increasing the dewatering rate.

However, formation of high permeability layers 130 and/or low permeability layers 150 on sloped surface 110 may present significant challenges. As an illustrative, non-exclusive example, it may be desirable to sequentially flow a slurry 93 of high permeability material 92 and a slurry 73 of low permeability mine tailings 72 down sloped surface 110 to form layers 130, 150 thereon. Slurry 73 of low permeability mine tailings 72 also may be referred to herein as low permeability slurry 73, low fluid permeability slurry 73, and/or slurry 73. Similarly, slurry 93 of high permeability material 92 also may be referred to herein as high permeability slurry 93, high fluid permeability slurry 93, and/or slurry 93.

Figure 5:
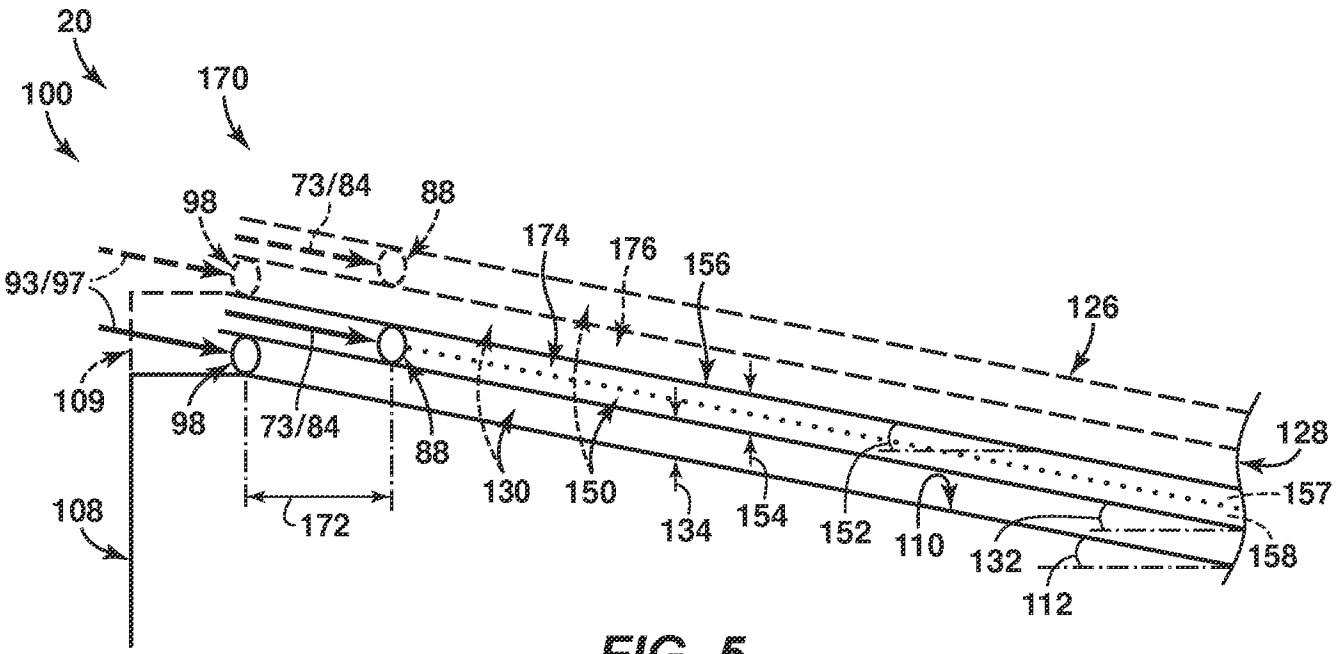
FIG. 5 is a less schematic cross-sectional view of illustrative, non-exclusive examples of the mine tailings dewatering site of FIG. 1.

As discussed in more detail herein, slurries 93, 73 may not inherently form (and/or be configured to form) uniform layers 130, 150 when flowed down the sloped surface, such as due to differences in a viscosity, a shear strength, and/or a natural slope of slurries 93, 73. Additionally or alternatively, and as also discussed in more detail herein, flow of slurries 93, 73 over layers 150, 130 may have a tendency to produce mixing of the slurries with one or more existing (i.e., previously formed) layers and/or otherwise may disturb the existing layers, thereby damaging and/or destroying the layered structure that is illustrated in FIGS. 1 and 5 and decreasing the dewatering rate that may be achieved thereby. However, the systems and methods disclosed herein permit formation of uniform layers 130, 150 of high permeability material 92 and low permeability mine tailings 72, respectively.

With continued reference to FIG. 1, sloped surface 110 may include, be, and/or be defined by any suitable structure that may define surface grade 112, which is schematically depicted and may be exaggerated for purpose of illustration in FIG. 1. As illustrative, non-exclusive examples, sloped surface 110 may include, be, and/or be defined by a berm and/or a dyke. As another illustrative, non-exclusive example, sloped surface 110 may be formed from a permeable material. As additional illustrative, non-exclusive examples, sloped surface 110 may include and/or be formed from sand, gravel, naturally occurring materials, and/or coarse sand tailings (CST) that may be generated by mining operation 20. Additionally or alternatively, sloped surface 110 may include and/or be one or more previously formed high permeability layers 130, one or more previously formed low permeability layers 150, and/or including interleaved layers, or stacks, of previously formed high permeability layers 130 and low permeability layers 150.

Illustrative, non-exclusive examples of surface grade 112 according to the present disclosure include surface grades of at least 0.1%, at least 0.2%, at least 0.25%, at least 0.5%, at least 0.75%, at least 1%, at least 1.25%, at least 1.5%, at least 1.75%, at least 2%, at least 2.25%, at least 2.5%, at least 2.75%, at least 3%, at least 3.25%, at least 3.5%, at least 3.75%, at least 4%, at least 4.25%, at least 4.5%, at least 4.75%, or at least 5%. Additional illustrative, non-exclusive examples of surface grade 112 according to the present disclosure include surface grades of less than 8.5%, less than 8%, less than 7.5%, less than 7%, less than 6.5%, less than 6%, less than 5.75%, less than 5.5%, less than 5.25%, less than 5%, less than 4.75%, less than 4.5%, less than 4.25%, less than 4%, less than 3.75%, less than 3.5%, less than 3.25%, less than 3%, less than 2.75%, less than 2.5%, less than 2.25%, less than 2%, less than 1.75%, or less than 1.5%.

High permeability layers 130 and/or low permeability layers 150, may collectively be referred to herein as layers 130, 150 and/or as sets or pairs of layers 130, 150. Layers 130, 150 may be planar, or at least substantially planar, layers 130, 150 that may be parallel to, or at least substantially parallel to, sloped surface 110. As discussed, high permeability layers 130 may be interleaved with, or spaced-apart from one another by, respective low permeability layers 150, thereby forming a layered structure 128 that includes a plurality of layers of differing, or sequentially varying, composition. As also discussed, this layered structure may improve the dewatering rate of low permeability mine tailings 72 by conveying fluid away from the low permeability mine tailings within the high permeability layers. As discussed in more detail herein, formation of uniform layers 130, 150 on a large scale and in a rapid and/or economical fashion may be improved, accomplished, and/or facilitated by matching a natural slope of slurry 73 to surface grade 112 of sloped surface 110 and/or by matching a natural slope of slurry 93 to the surface grade.

It is within the scope of the present disclosure that layers 130, 150 may be uniform, or at least substantially uniform, layers 130, 150. As an illustrative, non-exclusive example, a thickness of each layer 130, 150 (as illustrated in FIG. 5 at 134 and 154, respectively) may be, or may be controlled to be, within a threshold percentage of an average layer thickness (such as an average high permeability layer thickness and/or an average low permeability layer thickness) across at least a portion of an area 126 that is covered by the particular layer and/or across a length 124 of the particular layer. Thus, while layer 130 may have a different average layer thickness than a layer 150, each of layer 130 and layer 150 may have a uniform, or at least substantially uniform, layer thickness.

Illustrative, non-exclusive examples of the portion of area 126 that is covered by the layer and/or length 124 of the layer that may be uniform, or at least substantially uniform, include at least 50%, at least 55%, at least 60%, at least 65%, at least 70%, at least 75%, at least 80%, at least 85%, at least 90%, or at least 95% of the area that is covered by the layer and/or the length of the layer. Illustrative, non-exclusive examples of the threshold percentage of the average layer thickness include threshold percentages of less than 50%, less than 45%, less than 40%, less than 35%, less than 30%, less than 25%, less than 20%, less than 15%, less than 10%, or less than 5%. Illustrative, non-exclusive examples of the length 124 of the layer include lengths of at least 100 meters (m), at least 200 m, at least 300 m, at least 400 m, at least 500 m, at least 600 m, at least 700 m, at least 800 m, at least 900 m, at least 1000 m, at least 1200 m, at least 1400 m, at least 1600 m, at least 1800 m, or at least 2000m.

It is within the scope of the present disclosure that layers 130, 150 may define any suitable average layer thickness. Illustrative, non-exclusive examples of average high permeability layer thicknesses and/or average low permeability layer thicknesses include thicknesses of at least 1 centimeter (cm), at least 5 cm, at least 10 cm, at least 20 cm, at least 30 cm, at least 40 cm, at least 50 cm, at least 60 cm, at least 70 cm, at least 80 cm, at least 90 cm, at least 100 cm, at least 200 cm, at least 300 cm, at least 400 cm, at least 500 cm, at least 600 cm, at least 700 cm, at least 800 cm, at least 900 cm, or at least 1000 cm. Additional illustrative, non-exclusive examples of average high permeability layer thicknesses and/or average low permeability layer thicknesses include layer thicknesses of less than 1000 cm, less than 900 cm, less than 800 cm, less than 700 cm, less than 600 cm, less than 500 cm, less than 400 cm, less than 300 cm, less than 200 cm, less than 175 cm, less than 150 cm, less than 125 cm, less than 100 cm, less than 90 cm, less than 80 cm, less than 70 cm, less than 60 cm, or less than 50 cm.

Additionally or alternatively, it is also within the scope of the present disclosure that the average high permeability layer thickness may have any suitable magnitude, or value, relative to the average low permeability layer thickness. As illustrative, non-exclusive examples, a ratio of the average high permeability layer thickness to the average low permeability layer thickness may be at least 1:10, at least 1:9, at least 1:8, at least 1:7, at least 1:6, at least 1:5, at least 1:4, at least 1:3, at least 1:2, at least 1:1, or 1:1. Additionally or alternatively, the ratio of the average high permeability layer thickness to the average low permeability layer thickness may be less than 10:1, less than 9:1, less than 8:1, less than 7:1, less than 6:1, less than 5:1, less than 4:1, less than 3:1, less than 2:1, less than 1:1, less than 1:2, less than 1:3, less than 1:4, or less than 1:5.

As used herein, the terms "high permeability material" and "low permeability mine tailings" are relative terms that may refer to a relative permeability (or related property) of the high permeability material with respect to the low permeability mine tailings. As an illustrative, non-exclusive example, the high permeability material may have a high permeability material fluid permeability that is greater than a low permeability mine tailings fluid permeability of the low permeability mine tailings. As illustrative, non-exclusive examples, the high permeability material fluid permeability may be at least 2, at least 3, at least 4, at least 5, at least 10, at least 50, at least 100, at least 500, at least 1,000, at least 5,000, or at least 10,000 times greater than the low permeability mine tailings fluid permeability. Conversely, the low permeability mine tailings fluid permeability may be less than a high permeability material fluid permeability.

As another illustrative, non-exclusive example, the high permeability material may include a plurality of high permeability material particles that define an average diameter of the plurality of high permeability material particles (i.e., a diameter of a sphere that has the same volume as an average volume of the plurality of high permeability material particles). Similarly, the low permeability mine tailings may include a plurality of low permeability mine tailings particles that define an average diameter of the plurality of low permeability mine tailings (i.e., a diameter of a sphere that has the same volume as an average volume of the plurality of low permeability mine tailings particles).

It is within the scope of the present disclosure that the average diameter of the plurality of high permeability material particles may be greater than the average diameter of the plurality of low permeability mine tailings particles, and vice versa. As illustrative, non-exclusive examples, the average diameter of the plurality of high permeability material particles may be at least 1.1, at least 1.2, at least 1.25, at least 1.5, at least 1.75, at least 2, at least 2.5, at least 3, at least 3.5, at least 4, at least 4.5, at least 5, at least 6, at least 7, at least 8, at least 9, at least 10, or at least 20 times greater than the average diameter of the plurality of low permeability mine tailings particles.

As yet another illustrative, non-exclusive example, the high permeability material may define a high permeability sand-to-fines ratio, the low permeability mine tailings may define a low permeability mine tailings sand-to-fines ratio, and the high permeability material sand-to-fines ratio may be greater than the low permeability mine tailings sand-to-fines ratio, and vice versa. As used herein, the phrase "sand-to-fines ratio," or "SFR," may refer to a ratio of a weight of particles within a material that have a diameter, or equivalent diameter, that is greater than 44 micrometers to a weight of particles within the material that have a diameter, or equivalent diameter, that is less than 44 micrometers. Illustrative, non-exclusive examples of high permeability material sand-to-fines ratios according to the present disclosure include high permeability material sand-to-fines ratios that are least 1.1, at least 1.2, at least 1.3, at least 1.4, at least 1.5, at least 1.6, at least 1.7, at least 1.8, at least 1.9, at least 2, at least 2.25, at least 2.5, at least 2.75, at least 3, at least 3.5, at least 4, at least 4.5, or at least 5 times larger than the low permeability mine tailings sand-to-fines ratio.

High permeability material 92 may include and/or define any suitable material, property, and/or composition. As illustrative, non-exclusive examples, high permeability material 92 may include sand, coarse sand tailings, and/or high permeability mine tailings that may be produced by mining operation 20.

As another illustrative, non-exclusive example, the average diameter of the plurality of high permeability material particles may be greater than a threshold high permeability material average diameter. Illustrative, non-exclusive examples of threshold high permeability material average diameters according to the present disclosure include average diameters of at least 40 micrometers, at least 42 micrometers, at least 44 micrometers, at least 46 micrometers, at least 48 micrometers, and/or at least 50 micrometers.

As yet another illustrative, non-exclusive example, high permeability material 92 may define, or have, a high permeability material sand-to-fines ratio that is greater than a threshold high permeability material sand-to-fines ratio. Illustrative, non-exclusive examples of threshold high permeability material sand-to-fines ratios according to the present disclosure include sand-to-fines ratios of at least 1.5, at least 1.6, at least 1.7, at least 1.8, at least 1.9, at least 2, at least 2.1, at least 2.2, at least 2.3, at least 2.4, or at least 2.5.

As another illustrative, non-exclusive example, high permeability material 92 may define, or have, a fluid permeability that is greater than a threshold high permeability material fluid permeability. Illustrative, non-exclusive examples of threshold high permeability material fluid permeabilities according to the present disclosure include fluid permeabilities of at least 200 milliDarcy (mD), at least 400 mD, at least 600 mD, at least 800 mD, at least 1,000 mD, at least 1,200 mD, at least 1,400 mD, at least 1,600 mD, at least 1,800 mD, at least 2,000 mD, at least 2,500 mD, at least 3,000 mD, at least 4,000 mD, at least 5,000 mD, or at least 10,000 mD.

Similarly, low permeability mine tailings 72 and/or slurry 73 may include and/or define any suitable material, property, and/or composition. As illustrative, non-exclusive examples, low permeability mine tailings 72 and/or slurry 73 may include thickened tailings (TT), mature fine tailings (MFT), solvent recovery unit tailings (TSRU), and/or fluid fine tailings (FFT). As an illustrative, non-exclusive example, low permeability mine tailings 72 and/or slurry 73 may include at least 50 volume %, at least 60 volume %, at least 70 volume %, at least 80 volume %, at least 90 volume %, at least 95 volume %, or at least 99 volume % TT. As another illustrative, non-exclusive example, low permeability mine tailings 72 and/or slurry 73 may include at least 5 volume %, at least 10 volume %, at least 15 volume %, at least 20 volume %, at least 25 volume %, or at least 30 volume % MFT.

As yet another illustrative, non-exclusive example, low permeability mine tailings 72 and/or slurry 73 may include at least 40 wt % water, at least 45 wt % water, at least 50 wt % water, at least 55 wt % water, at least 60 wt % water, at least 65 wt % water, or at least 70 wt % water. Additionally or alternatively, the low permeability mine tailings also may include less than 60 wt % solids, less than 55 wt % solids, less than 50 wt % solids, less than 45 wt % solids, less than 40 wt % solids, less than 35 wt % solids, or less than 30 wt % solids.

As another illustrative, non-exclusive example, the average diameter of the plurality of low permeability mine tailings particles may be less than a threshold low permeability mine tailings average diameter. Illustrative, non-exclusive examples of threshold low permeability mine tailings average diameters according to the present disclosure include diameters of less than 46 micrometers, less than 44 micrometers, less than 42 micrometers, less than 40 micrometers, less than 38 micrometers, less than 36 micrometers, less than 30 micrometers, less than 20 micrometers, less than 10 micrometers, less than 5 micrometers, or less than 2 micrometers.

As yet another illustrative, non-exclusive example, low permeability mine tailings 72 may define, or have, a low permeability mine tailings sand-to-fines ratio that is less than an upper threshold low permeability mine tailings sand-to-fines ratio, illustrative, non-exclusive examples of which include sand-to-fines ratios of less than 1.5, less than 1.4, less than 1.3, less than 1.2, less than 1.1, less than 1.0, less than 0.9, or less than 0.8. Additionally or alternatively, the low permeability mine tailings sand-to-fines ratio also may be greater than a lower threshold low permeability mine tailings sand-to-fines ratio, illustrative, non-exclusive examples of which include sand-to-fines ratios of at least 0.1, at least 0.2, at least 0.3, at least 0.4, at least 0.5, at least 0.6, at least 0.7, at least 0.8, at least 0.9, or at least 1.

As another illustrative, non-exclusive example, low permeability mine tailings 72 may define, or have, a fluid permeability that is less than an upper threshold low permeability mine tailings fluid permeability, illustrative, non-exclusive examples of which include fluid permeabilities of less than 1000 milliDarcy (mD), less than 900 mD, less than 800 mD, less than 700 mD, less than 600 mD, less than 500 mD, less than 400 mD, less than 300 mD, less than 200 mD, less than 150 mD, less than 100 mD, less than 90 mD, less than 80 mD, less than 70 mD, less than 60 mD, less than 50 mD, less than 40 mD, less than 30 mD, less than 20 mD, or less than 10 mD. Additionally or alternatively, the low permeability mine tailings also may define, or have, a fluid permeability that is greater than a lower threshold low permeability mine tailings fluid permeability, illustrative, non-exclusive examples of which include fluid permeabilities of at least 1 mD, at least 2.5 mD, at least 5 mD, at least 7.5 mD, at least 20 mD, at least 20 mD, at least 30 mD, at least 40 mD, or at least 50 mD.

As illustrated in FIG. 1, and as discussed herein, mine tailings dewatering site 100 may form a portion of mining operation 20. Mining operation 20 may include a tailings generation site 30 that generates a mine tailings stream 40. Mine tailings stream 40 may be received by a thickening assembly 50. Although not required to all embodiments, thickening assembly 50 also may receive a flocculant 60 and may mix the mine tailings stream and the flocculant therein to produce slurry 73 of low permeability mine tailings 72. Flocculant 60 may be selected to produce, or generate, flocculation, coagulation, and/or agglomeration of mine tailings stream 40, thereby decreasing a water content thereof.

In addition, and as illustrated in dashed lines in FIG. 1, mining operation 20 and/or mine tailings dewatering site 100 may include a mixing structure 80, which also may be referred to herein as a first mixing structure 80 and/or as a low permeability mine tailings mixing structure 80. Mixing structure 80 may receive slurry 73 and a low permeability mine tailings additive 82 and may generate an augmented slurry 84 of low permeability mine tailings 72 therefrom. Slurry 73 and/or augmented slurry 84, when present, which may be collectively referred to herein as slurry 73/84, may be provided to mine tailings dewatering site 100 and utilized to form low permeability layers 150.

Similarly, mining operation 20 and/or mine tailings dewatering site 100 also may include a mixing structure 90, which also may be referred to herein as a second mixing structure 90 and/or as a high permeability material mixing structure 90. Mixing structure 90 may receive slurry 93 and high permeability material additive 94 and may generate an augmented slurry 97 of high permeability material 92 therefrom. Slurry 93 and/or augmented slurry 97, when present, which may be collectively referred to herein as slurry 93/97, may be provided to mine tailings dewatering site 100 and utilized to form high permeability layers 130.

As also illustrated in dashed lines in FIG. 1, mining operation 20 and/or mine tailings dewatering site 100 also may include a controller 190 that may be adapted, configured, and/or programmed to control the operation of at least a portion of the mining operation. As an illustrative, non-exclusive example, and as illustrated in dotted lines in FIG. 1, controller 190 may be in communication with any suitable portion of mining operation 20, such as tailings generation site 30, thickening assembly 50, mixing structure(s) 80, 90, and/or mine tailings dewatering site 100. This may include providing any suitable control signal 194 to, and/or receiving any suitable status signal 196 from, the portion of the mining operation. As an illustrative, non-exclusive example, mining operation 20 may include one or more detectors 192, and controller 190 may receive status signal(s) 196 from the one or more detectors.

As discussed herein, high permeability layers 130 may be located on sloped surface 110 by flowing slurry 93/97 across the sloped surface and in contact with a respective low permeability layer 150 that is located therebelow. This may include flowing slurry 93/97 from one or more high permeability material discharge outlets 98, as illustrated in dashed lines in FIG. 1. Similarly, low permeability layers 150 may be located on sloped surface 110 by flowing slurry 73/84 across the sloped surface and in contact with a respective high permeability layer 130 that is located therebelow. This may include flowing slurry 73/84 from one or more low permeability mine tailings discharge outlets 88, as also illustrated in dashed lines in FIG. 1.

It may be desirable to decrease a potential for mixing between the high permeability layers and the low permeability layers as the layers are formed on the sloped surface. In general, slurry 93/97 of high permeability material 92 may be more likely to displace, erode, disturb, and/or mix with the low permeability layer when flowing thereacross, while slurry 73/84 of low permeability mine tailings 72 may be less likely to displace, erode, disturb, and/or mix with the high permeability layer when flowing thereacross. This may be due to a variety of factors, including a larger particle size within the high permeability layer, a faster dewatering rate of the high permeability layer when compared to the low permeability layer, a higher density of the high permeability material when compared to the low permeability mine tailings, and/or a higher flow rate of slurry 93/97 when flowed down the sloped surface compared to a flow rate of slurry 73/84 when flowed down the sloped surface.

Thus, mine tailings dewatering site 100 may include an energy dissipation region 170 that is configured to decrease a kinetic energy of slurry 93/97 as it flows down the sloped surface and prior to contact between slurry 93/97 and the low permeability layer that is therebelow. As an illustrative, non-exclusive example, the energy dissipation region may include and/or be defined in a region, space, and/or gap that may be present between high permeability material discharge outlet 98 and low permeability mine tailings discharge outlet 88. Thus, and as illustrated in FIG. 1, high permeability material discharge outlet 98 may be located at least a threshold distance 172 uphill from low permeability mine tailings discharge outlet 88, and the space therebetween may function as energy dissipation region 170 and/or may permit slurry 93/97 of high permeability material 92 to dissipate a portion of its kinetic energy as it flows from high permeability material discharge outlet 98 and before contact with a given low permeability layer 150.

Energy dissipation region 170 may include any suitable material of construction and/or may define any suitable structure. As illustrative, non-exclusive examples, energy dissipation region 170 may be formed from and/or may include sand, gravel, high permeability material 92, previously deposited high permeability material 92, and/or a plurality of previously deposited layers of high permeability material 92.

Illustrative, non-exclusive examples of threshold distance 172 according to the present disclosure include threshold distances of at least 25 meters (m), at least 50 m, at least 75 m, at least 100 m, at least 125 m, at least 150 m, at least 175 m, or at least 200 m. Additional illustrative, non-exclusive examples of threshold distance 172 include threshold distances of less than 300 m, less than 275 m, less than 250 m, less than 225 m, less than 200 m, less than 175 m, less than 150 m, less than 125 m, or less than 100 m.

Tailings generation site 30 may include any suitable structure that may generate mine tailings stream 40. As illustrative, non-exclusive examples, tailings generation site 30 may include and/or be a mine, a strip mine, a hydrocarbon mine, a bitumen mine, an oil sands mine, a tar sands mine, a bituminous sands mine, and/or a separation assembly that is configured to receive an ore stream and to produce a hydrocarbon stream and mine tailings stream 40 therefrom.

Mine tailings stream 40 may include any suitable composition. As illustrative, non-exclusive examples, the mine tailings stream may include and/or be a mixture, slurry, and/or suspension of solids in a fluid, such as water. As another illustrative, non-exclusive example, the solids may comprise at least 6 wt %, at least 8 wt %, at least 10 wt %, or at least 12 wt % of the mine tailings stream. As yet another illustrative, non-exclusive example, the solids may comprise less than 20 wt %, less than 18 wt %, less than 16 wt %, less than 14 wt %, or less than 12 wt % of the mine tailings stream.

Thickening assembly 50 may include any suitable structure that is configured to receive mine tailings stream 40 and flocculant 60 and to produce slurry 73 therefrom. As an illustrative, non-exclusive example, thickening assembly 50 may include a tank that is configured to retain a mixture of the mine tailings stream and the flocculant for at least a threshold flocculation time to permit flocculation of the mine tailings stream. As another illustrative, non-exclusive example, slurry 73 may include and/or be a bottoms stream and/or an underflow stream that may be produced from the tank.

Slurry 73 may include any suitable composition. As an illustrative, non-exclusive example, slurry 73 of low permeability mine tailings 72 may include solids in a fluid, such as water. As another illustrative, non-exclusive example, the solids may comprise at least 20 wt %, at least 25 wt %, at least 30 wt %, at least 35 wt %, at least 40 wt %, at least 45 wt %, at least 50 wt %, or at least 55 wt % of slurry 73. As yet another illustrative, non-exclusive example, the solids may comprise less than 75 wt %, less than 70 wt %, 65 wt %, less than 60 wt %, less than 55 wt %, less than 50 wt %, or less than 45 wt % of slurry 73.

As illustrated in dashed lines in FIG. 1, a pipe 65 may convey slurry 73 between thickening assembly 50 and mine tailings dewatering site 100. In general, and subsequent to being produced from the thickening assembly, slurry 73 may have a relatively high shear strength. However, transport of slurry 73 through pipe 65 may decrease, potentially significantly, the shear strength of the slurry. Thus, it may be desirable to limit, decrease, and/or minimize a length of pipe 65, thereby preserving a significant fraction of the shear strength of the slurry, such as at least 20%, at least 30%, at least 40%, at least 50%, at least 60%, at least 70%, at least 80%, or at least 90% of the shear strength of the slurry.

However, in practice, it may be impractical to locate mine tailings dewatering site 100 proximal to tailings generation site 30 and/or thickening assembly 50 due to geographic and/or spatial constraints. This increases a need for and/or benefit of mine tailings dewatering site 100 according to the present disclosure. With this in mind, and while it is within the scope of the present disclosure that slurry 73 may be conveyed in any suitable manner and/or over any suitable distance between thickening assembly 50 and mine tailings dewatering site 100, pipe 65 may have a length of at least 100 meters (m), at least 200 m, at least 300 m, at least 400 m, at least 500 m, at least 600 m, at least 700 m, at least 800 m, at least 900 m, at least 1000 m, at least 1250 m, at least 1500 m, at least 1750 m, or at least 2000 m.

As discussed in more detail herein, it may be desirable to form uniform, or at least substantially uniform, high permeability layers 130 and/or low permeability layers 150 on sloped surface 110 and/or within mine tailings dewatering site 100, such as to permit efficient dewatering of low permeability layers 150 and/or low permeability mine tailings 72 thereof. With this in mind, and as discussed in more detail herein with reference to FIGS. 2-4, it may be desirable to match a natural slope of slurry 73/84 of low permeability mine tailings 72 and/or a natural slope of slurry 93/97 of high permeability material to surface grade 112 of sloped surface 110.

In general, and as discussed herein, the natural slope of slurry 73 and/or the natural slope of slurry 93 may not match surface grade 112. However, the natural slope of slurry 73 and/or of slurry 93 may be changed, adjusted, defined, and/or selected through the addition of one or more additives, such as low permeability mine tailings additive 82 and/or high permeability material additive 94, thereto. This adjustment of the natural slope of slurry 73 and/or slurry 93 may permit the formation of uniform high permeability layers 130 and/or low permeability layers 150 on sloped surface 110.

As an illustrative, non-exclusive example, the natural slope of slurry 73 and/or of slurry 93 may be adjusted and/or controlled to be within a threshold grade difference of surface grade 112 of sloped surface 110. Illustrative, non-exclusive examples of threshold grade differences according to the present disclosure include threshold grade differences of less than 4%, less than 3%, less than 2%, less than 1.75%, less than 1.5%, less than 1.25%, less than 1%, less than 0.9%, less than 0.8%, less than 0.7%, less than 0.6%, less than 0.5%, less than 0.4%, less than 0.3%, less than 0.2%, or less than 0.1% grade.

With this in mind, mining operation 20 and/or mine tailings dewatering site 100 according to the present disclosure also may (but is not required in all embodiments to) include mixing structures 80, 90 and/or an associated controller 190. When present, and as discussed, mixing structure 80 may be configured to blend, mix, and/or otherwise combine slurry 73 of low permeability mine tailings 72 with low permeability mine tailings additive 82 to generate augmented slurry 84 of low permeability mine tailings 72. This may include changing and/or adjusting the shear strength, viscosity, and/or natural slope of slurry 73 (i.e., the shear strength, viscosity, and/or natural slope of slurry 73 may be different from the shear strength, viscosity, and/or natural slope of augmented slurry 84) to match, or match within the threshold grade difference, the natural slope of augmented slurry 84 to surface grade 112.

Similarly, mixing structure 90 may be configured to blend, mix, and/or otherwise combine slurry 93 of high permeability material 92 with high permeability material additive 94 to generated augmented slurry 97 of high permeability material 92. This may include changing and/or adjusting the shear strength, viscosity, and/or natural slope of slurry 93 (i.e., the shear strength, viscosity, and/or natural slope of slurry 93 may be different from the shear strength, viscosity, and/or natural slope of augmented slurry 97) to match, or match within the threshold grade difference, the natural slope of augmented slurry 97 to surface grade 112.

It is also within the scope of the present disclosure that mixing structure(s) 80 and/or 90, or additional mixing structures, may be used to further combine one or more additives with augmented slurry 84/97 to further adjust the shear strength, viscosity, and/or natural slope thereof. Mixing structures 80, 90 may include any suitable structure. As an illustrative, non-exclusive example, mixing structures 80, 90 may include and/or be an injection port on a pipe, such as pipe 65. As another illustrative, non-exclusive example, mixing structures 80, 90 may include and/or be a mixing vessel.

It is within the scope of the present disclosure that mixing structures 80, 90 may be located any suitable distance from mine tailings dewatering site 100. As illustrative, non-exclusive examples, mixing structures 80, 90 may be located less than 250 m, less than 200 m, less than 150 m, less than 100 m, less than 50 m, less than 25 m, less than 10 m, less than 5 m, or less than 1 m from the mine tailings dewatering site.

High permeability material additive 94 may include any suitable material, composition, and/or chemical composition that may change and/or adjust the shear strength, viscosity, and/or natural slope of slurry 93 of high permeability material 92. Illustrative, non-exclusive examples of high permeability material additive 94 according to the present disclosure include water soluble materials, water insoluble materials, polymers, flocculants, desiccants, coagulants, anionic polyacrylamides, dispersants, clays, thickened tailings, mature fine tailings, fluid fine tailings, the slurry of the low permeability mine tailings, a material that decreases the fluid permeability of the high permeability layer, a material that increases the fluid permeability of the high permeability layer, and/or mixtures of the above.

It is within the scope of the present disclosure that each high permeability layer 130 may include high permeability material additive 94 and/or that each high permeability layer 130 may include the same high permeability material additive 94. However, it is also within the scope of the present disclosure that at least a portion of the high permeability layers may not include the high permeability material additive and/or that a first portion of the high permeability layers may include a different high permeability material additive, or a different concentration of the high permeability material additive, than a second portion of the high permeability layers.

Regardless of the exact composition of high permeability material additive 94 within augmented slurry 97, and/or high permeability layers 130 that may be formed therefrom, the concentration and/or composition of the high permeability material additive that is present therein may be selected and/or controlled such that the natural slope of augmented slurry 97 is within the threshold grade difference of surface grade 112 and/or within the threshold grade difference of the natural slope of slurry 73 (or slurry 84, when present). As illustrative, non-exclusive examples, the natural slope of augmented slurry 97 may be at least 0.1%, at least 0.2%, at least 0.25%, at least 0.5%, at least 0.75%, at least 1%, at least 1.25%, at least 1.5%, at least 1.75%, at least 2%, at least 2.25%, at least 2.5%, at least 2.75%, at least 3%, at least 3.25%, at least 3.5%, at least 3.75%, at least 4%, at least 4.25%, at least 4.5%, at least 4.75%, or at least 5% grade. As another illustrative, non-exclusive example, the natural slope of augmented slurry 97 may be less than 7.5%, less than 7%, less than 6.5%, less than 6%, less than 5.75%, less than 5.5%, less than 5.25%, less than 5%, less than 4.75%, less than 4.5%, less than 4.25%, less than 4%, less than 3.75%, less than 3.5%, less than 3.25%, less than 3%, less than 2.75%, less than 2.5%, less than 2.25%, less than 2%, less than 1.75%, or less than 1.5% grade.

Low permeability mine tailings additive 82 may include any suitable material, composition, and/or chemical composition that may change and/or adjust the shear strength, viscosity, and/or natural slope of slurry 73 of low permeability mine tailings 72. Illustrative, non-exclusive examples of low permeability mine tailings additive 82 according to the present disclosure include water soluble materials, water insoluble materials, polymers, flocculants, desiccants, coagulants, anionic polyacrylamides, a material that increases the fluid permeability of the low permeability layer, and/or mixtures of the above.

It is within the scope of the present disclosure that each low permeability layer 150 may include low permeability mine tailings additive 82 and/or that each low permeability layer 150 may include the same low permeability mine tailings additive 82. However, it is also within the scope of the present disclosure that at least a portion of the low permeability layers may not include the low permeability mine tailings additive and/or that a first portion of the low permeability layers may include a different low permeability mine tailings additive, or a different concentration of the low permeability mine tailings additive, than a second portion of the low permeability layers.

Regardless of the exact composition of low permeability mine tailings additive 82 within augmented slurry 84 and/or low permeability layers 150 that may be formed therefrom, the concentration and/or composition of the low permeability mine tailings additive may be selected and/or controlled such that the natural slope of augmented slurry 84 is within the threshold grade difference of surface grade 112 and/or within the threshold grade difference of the natural slope of slurry 93 (or augmented slurry 97, when present). As an illustrative, non-exclusive example, the natural slope of augmented slurry 84 may be at least 0.1%, at least 0.2%, at least 0.25%, at least 0.5%, at least 0.75%, at least 1%, at least 1.25%, at least 1.5%, at least 1.75%, at least 2%, at least 2.25%, at least 2.5%, at least 2.75%, at least 3%, at least 3.25%, at least 3.5%, at least 3.75%, at least 4%, at least 4.25%, at least 4.5%, at least 4.75%, or at least 5% grade. As another illustrative, non-exclusive example, the natural slope of augmented slurry 84 may be less than 8.5%, less than 8%, less than 7.5%, less than 7%, less than 6.5%, less than 6%, less than 5.75%, less than 5.5%, less than 5.25%, less than 5%, less than 4.75%, less than 4.5%, less than 4.25%, less than 4%, less than 3.75%, less than 3.5%, less than 3.25%, less than 3%, less than 2.75%, less than 2.5%, less than 2.25%, less than 2%, less than 1.75%, or less than 1.5% grade.

As discussed, mining operation 20 and/or mine tailings dewatering site 100 optionally may include and/or be in communication with controller 190, which may be adapted, configured, and/or programmed to control the operation of at least a portion of the mining operation and/or the mine tailings dewatering site. As an illustrative, non-exclusive example, controller 190 may receive one or more status signal(s) 196 that may be indicative of a shear strength, a viscosity, and/or a natural slope of slurry 73 of low permeability mine tailings 72 and/or of slurry 93 of high permeability material 92. As another illustrative, non-exclusive example, controller 190 may control the operation of mixing structure(s) 80 and/or 90 based, at least in part, on status signals 196. This may include controlling a shear strength, viscosity, and/or natural slope of augmented slurry 84 and/or of augmented slurry 97 to a desired, or target, value that may generate uniform layers 130, 150 within mine tailings dewatering site 100 and/or that may match the natural slope of these materials to surface grade 112. As another illustrative, non-exclusive example, controller 190 may control the operation of mining operation 20 and/or mine tailings dewatering site 100 by performing any of the methods 200 that are discussed herein.

As used herein, the term "natural slope" of a material may refer to a threshold slope, or grade, of a sloped surface above which the material will slip, or slide, down the sloped surface when placed thereon and below which the material will remain on the sloped surface when placed thereon. The "natural slope" of the material also may be referred to herein as a "natural grade" of the material.

When the material is a slurry (such as slurry 73 of low permeability mine tailings 72, augmented slurry 84 of low permeability mine tailings 72, slurry 93 of high permeability material 92, and/or slurry 97 of high permeability material 92), the phrase "natural slope" also may refer to a slope, grade, and/or angle that the slurry may naturally form, may seek, may approach and/or may flow toward as the slurry flows down the sloped surface. Additionally or alternatively, the phrase "natural slope" also may refer to a surface grade of the sloped surface at which the slurry will form a uniform, or uniform thickness, layer as it flows down the sloped surface. This is illustrated schematically in FIGS. 2-4.

Figure 2:
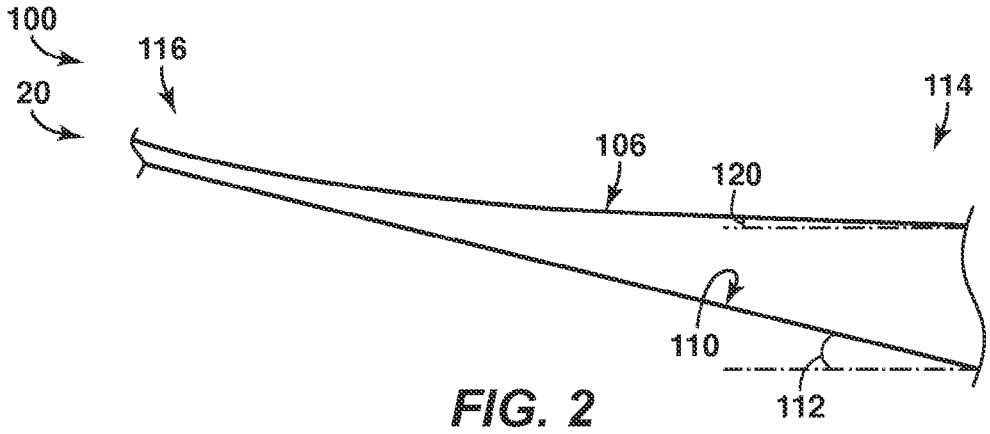
FIG. 2 is a schematic cross-sectional view of an illustrative, non-exclusive example of a slurry flowing down a sloped surface, wherein a natural slope of the slurry is less than a surface grade of the sloped surface.

FIG. 2 is a schematic cross-sectional view of an illustrative, non-exclusive example of a slurry 106 flowing down a sloped surface 110, wherein a natural slope 120 of the slurry is less than a surface grade 112 of the sloped surface. Under these conditions, and as illustrated, slurry 106 will not form a uniform layer on the sloped surface (such as by forming a layer of constant, or at least substantially constant, thickness across a length of the sloped surface). Instead, slurry 106 will flow down the sloped surface and collect, or pool, on a downhill side 114 thereof.

Figure 3:
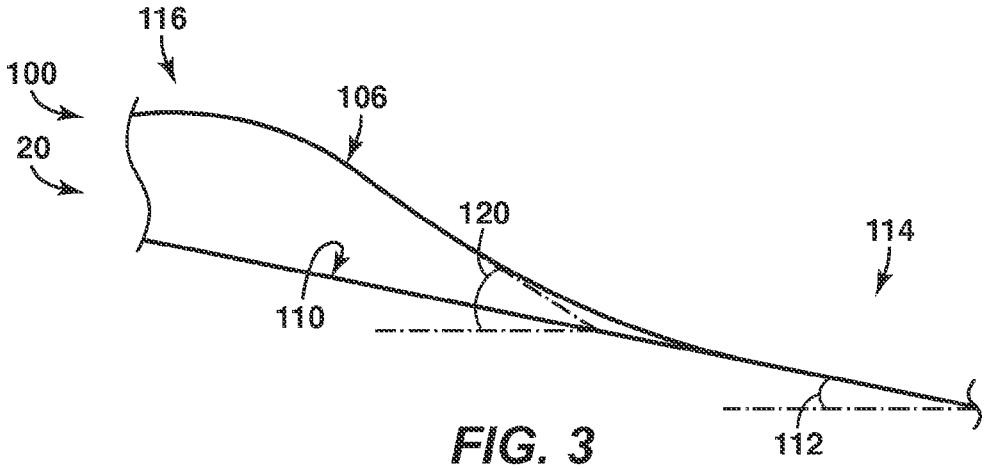
FIG. 3 is a schematic cross-sectional view of an illustrative, non-exclusive example of a slurry flowing down a sloped surface, wherein a natural slope of the slurry is greater than a surface grade of the sloped surface.

In contrast, FIG. 3 is a schematic cross-sectional view of an illustrative, non-exclusive example of a slurry 106 flowing down a sloped surface 110, wherein a natural slope 120 of the slurry is greater than a surface grade 112 of the sloped surface. Once again, slurry 106 will not form a uniform layer on the sloped surface. Instead, slurry 106 will collect on, or near, an uphill side 116 thereof.

In general, the natural slope of a slurry may be a result of a shear strength and/or viscosity of the slurry. As such, changing the shear strength and/or viscosity of the slurry, such as by combining an additive therewith (such as low permeability mine tailings additive 82 and/or high permeability material additive 94) may change the natural slope of the slurry.

In the context of mine tailings dewatering site 100 according to the present disclosure, and with reference to FIG. 1, slurry 73 of low permeability mine tailings 72 may have, or define, a natural slope that is different from surface grade 112 and/or that is different from the natural slope of slurry 93 of high permeability material 92. As illustrative, non-exclusive examples, and prior to the addition of low permeability mine tailings additive 82 thereto, slurry 73 may have, or define, a natural slope of less than 1%, less than 0.9%, less than 0.8%, less than 0.7%, less than 0.6%, less than 0.5%, less than 0.4%, less than 0.3%, less than 0.2%, less than 0.1%, or a natural slope of 0% grade.

Similarly, slurry 93 of high permeability material 92 may have, or define, a natural slope that is different from surface grade 112 and/or that is different from the natural slope of slurry 73 of low permeability mine tailings 72. As illustrative, non-exclusive examples, and prior to the addition of high permeability material additive 94 thereto, slurry 93 may have, or define, a natural slope of less than 10%, less than 9%, less than 8%, less than 7%, less than 6%, less than 5.75%, less than 5.5%, less than 5.25%, less than 5%, less than 4.75%, less than 4.5%, less than 4.25%, less than 4%, less than 3.75%, less than 3.5%, less than 3.25%, less than 3%, less than 2.75%, less than 2.5%, less than 2.25%, or less than 2% grade. Additionally or alternatively, slurry 93 also may have, or define, a natural slope of greater than 1%, greater than 1.25%, greater than 1.5%, greater than 1.75%, greater than 2%, greater than 2.25%, greater than 2.5%, greater than 2.75%, greater than 3%, greater than 3.25%, greater than 3.5%, greater than 3.75%, greater than 4%, greater than 4.25%, or greater than 4.5% grade.

Figure 4:
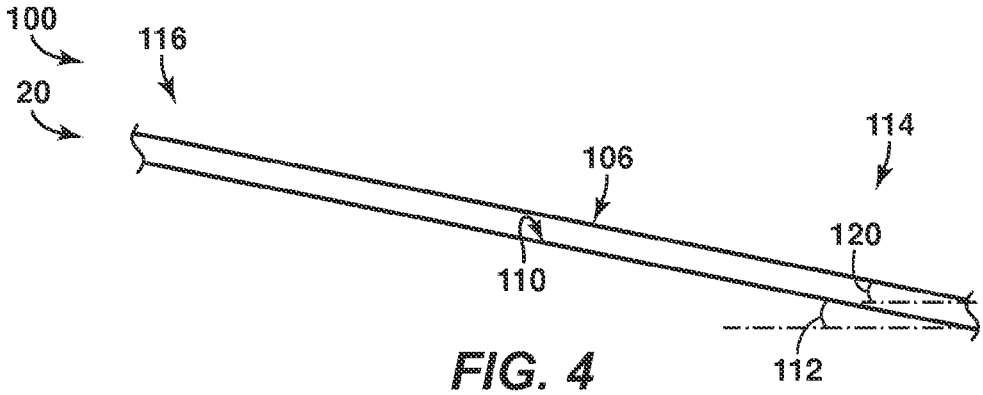
FIG. 4 is a schematic cross-sectional view of an illustrative, non-exclusive example of a slurry flowing down a sloped surface, wherein a natural slope of the slurry is at least substantially equal to a surface grade of the sloped surface.

Thus, and as discussed, the systems and methods according to the present disclosure may include the formation of augmented slurry 84 and/or augmented slurry 97 such that the natural slope of the slurries that are flowed down sloped surface 110 match surface grade 112, or are matched to surface grade 112 to within the threshold grade difference. Under these conditions, and as illustrated in FIG. 4, slurry 106 may form a uniform, or at least substantially uniform, layer on sloped surface 110. Additionally or alternatively, the systems and methods according to the present disclosure may include formation of augmented slurry 84 and/or augmented slurry 97 such that the natural slope of the slurries match to each other (when both are present) and/or to the natural slope of the contrasting unaugmented slurry (when only one of slurry 84 and slurry 97 is present). As discussed, this may include matching to within the threshold grade difference.

FIG. 5 is a less schematic cross-sectional view of illustrative, non-exclusive examples of a mine tailings dewatering site 100 according to the present disclosure that may be included in and/or may be the mine tailings dewatering site of FIG. 1. As illustrated in FIG. 5, sloped surface 110 may form a portion of a berm 108, which also may be referred to herein as a dyke 108, and which defines surface grade 112. In the illustrative, non-exclusive example of FIG. 5, a first high permeability layer 130 has been located in contact with and above sloped surface 110, and a first low permeability layer 150 has been located in contact with and above the first high permeability layer. In addition, and as shown in dashed lines in FIG. 5, a second high permeability layer 130 may be located in contact with and above the first low permeability layer, and a second low permeability layer 150 may be located in contact with and above the second high permeability layer.

While FIG. 5 illustrates a total of four layers, it is within the scope of the present disclosure that mine tailings dewatering site 100 may include any suitable number of layers 130, 150. As illustrative, non-exclusive examples, the mine tailings dewatering site may include at least 2, at least 3, at least 4, at least 5, at least 10, at least 15, at least 20, at least 25, at least 30, at least 35, at least 40, at least 45, or at least 50 high permeability layers 130 and/or low permeability layers 150.

In the mine tailings dewatering site of FIG. 5, slurry 93/97 of high permeability material 92 may be supplied from high permeability material discharge outlet 98 and may flow down sloped surface 110 to form high permeability layers 130. Similarly, slurry 73/84 of low permeability mine tailings 72 may be supplied from low permeability mine tailings discharge outlet 88 and may flow down the sloped surface to form low permeability layers 150. As discussed, energy dissipation region 170, which may be present within threshold distance 172 between outlet 98 and outlet 88, may decrease the kinetic energy of slurry 93/97 prior to contact between the slurry and a low permeability layer 150 that is located therebeneath.

As illustrated, layers 130, 150 are uniform, or at least substantially uniform, along the length (or area 126) of sloped surface 110. As discussed, this uniformity may include a constant, or at least substantially constant, thickness 134 of high permeability layer 130 and a constant, or at least substantially constant, thickness 154 of low permeability layer 150 across the length and/or area of the layers. As also discussed, this uniformity may be achieved when natural slope 132 of slurry 93/97 and natural slope 152 of slurry 73 are equal to surface grade 112 or are matched to surface grade 112 to within the threshold grade difference.

As illustrated in dashed lines in FIG. 5 at 109, a height of berm 108 may be increased subsequent to and/or during formation of a respective low permeability layer 150 and prior to formation of a respective high permeability layer 130 that is above and in contact with the low permeability layer. This increase in the berm height may permit slurry 93/97 to flow under the influence of gravity through energy dissipation region 170 prior to flowing across the respective low permeability layer, may permit defining a desired grade within energy dissipation region 170, and/or may permit matching of the grade of energy dissipation region 170 to surface grade 112.

As discussed in more detail herein with reference to methods 200, formation of layers 130, 150 may include waiting at least a threshold dewatering time after formation of a given layer 174 and prior to formation of a subsequent layer 176 that is above (or vertically above) and in contact with the given layer. Waiting the threshold dewatering time may permit formation of the subsequent layer without, without significant, and/or without more than a threshold amount of damage to, erosion of, displacement of, and/or disturbance of the given layer.

Illustrative, non-exclusive examples of threshold dewatering times according to the present disclosure include threshold dewatering times of at least 0.1 days, at least 0.25 days, at least 0.5 days, at least 1 day, at least 2 days, at least 3 days, at least 4 days, at least 5 days, at least 6 days, at least 7 days, at least 8 days, at least 9 days, at least 10 days, at least 12 days, at least 14 days, at least 16 days, at least 18 days, at least 20 days, at least 22 days, at least 24 days, at least 27 days, or at least 28 days. Additional illustrative, non-exclusive examples of threshold dewatering times according to the present disclosure include threshold dewatering times of fewer than 40 days, fewer than 35 days, fewer than 30 days, fewer than 29 days, fewer than 28 days, fewer than 26 days, fewer than 24 days, fewer than 22 days, fewer than 20 days, fewer than 18 days, fewer than 16 days, fewer than 14 days, fewer than 12 days, fewer than 10 days, fewer than 8 days, or fewer than 6 days.

As used herein, the term "given" may be utilized to indicate a selected, individual, and/or indicated structure and/or embodiment. As an illustrative, non-exclusive example, the given layer (such as the low permeability layer that is indicated in solid lines in FIG. 5) may define an exposed surface 156 prior to formation of the subsequent layer. In addition, and subsequent to the threshold dewatering time, the given layer further may define a first region 157, which includes and/or defines the exposed surface, and a second region 158, which is vertically below, or otherwise beneath, the first region.

The first region and the second region may have dewatered at different rates and thus may contain different fluid and/or solids contents. As an illustrative, non-exclusive example, the first region may be dewatered, or at least dewatered to a greater degree than the second region, while the second region may not be dewatered, or at least may contain more water than the first region.

As another illustrative, non-exclusive example, the solids content of the first region may be greater than the solids content of the second region, and thus the solids content of the second region may be less than the solids content of the first region. As illustrative, non-exclusive examples, the solids content of the first region may be at least 40 wt %, at least 45 wt %, at least 50 wt %, at least 55 wt %, at least 60 wt %, at least 61 wt %, at least 62 wt %, at least 63 wt %, at least 64 wt %, at least 65 wt %, at least 66 wt %, at least 67 wt %, at least 68 wt %, at least 69 wt %, or at least 70 wt %. Additionally or alternatively, the solids content of the second region may be less than 70 wt %, less than 68 wt %, less than 65 wt %, less than 64 wt %, less than 63 wt %, less than 62 wt %, less than 61 wt %, less than 60 wt %, less than 59 wt %, less than 58 wt %, less than 57 wt %, less than 56 wt %, or less than 55 wt %.

While the solids content of the second region may be less than the solids content of the first region, it is within the scope of the present disclosure that the solids content of the second region still may be greater than the solids content of the slurry that formed the respective layer (such as slurry 73 of low permeability mine tailings 72). As illustrative, non-exclusive examples, the solids content of slurry 73 of low permeability mine tailings 72 may be less than 60 wt %, less than 57.5 wt %, less than 55 wt %, less than 52.5 wt %, less than 50 wt %, less than 47.5 wt %, less than 45 wt %, less than 42.5 wt %, less than 40 wt %, less than 37.5 wt %, or less than 35 wt %.

Additionally or alternatively, a shear strength of the first region may be greater than a shear strength of the second region, which may be greater than the shear strength of the slurry that formed the respective layer (such as slurry 73 of low permeability mine tailings 72). As illustrative, non-exclusive examples, the shear strength of the first region may be is at least 0.1 kPa (kilopascals), at least 0.2 kPa, at least 0.3 kPa, at least 0.4 kPa, at least 0.5 kPa, at least 0.6 kPa, at least 0.7 kPa, at least 0.8 kPa, at least 0.9 kPa, at least 1 kPa, at least 2.5 kPa, at least 5 kPa, at least 7.5 kPa, or at least 10 kPa. Additionally or alternatively, the shear strength of the second region may be less than 2 kPa, less than 1.5 kPa, less than 1 kPa, less than 0.75 kPa, less than 0.5 kPa, less than 0.4 kPa, less than 0.3 kPa, less than 0.2 kPa, less than 0.1 kPa, less than 0.075 kPa, less than 0.05 kPa, less than 0.025 kPa, or less than 0.01 kPa.

It is within the scope of the present disclosure that first region 157 and/or second region 158 may comprise any suitable portion of given layer 174. As an illustrative, non-exclusive example, the given layer may define a layer volume (or a low permeability layer volume when the given layer is low permeability layer 150), and the first region may comprise a fraction of the layer volume. As illustrative, non-exclusive examples, the first region may comprise at least 5%, at least 7.5%, at least 10%, at least 12.5%, at least 15%, at least 17.5%, at least 20%, at least 22.5%, at least 25%, at least 27.5%, or at least 30% of the layer volume. Additionally or alternatively, the first region also may comprise less than 40%, less than 37.5%, less than 35%, less than 32.5%, less than 30%, less than 27.5%, less than 25%, less than 22.5%, less than 20%, less than 17.5%, less than 15%, less than 12.5%, or less than 10% of the layer volume.

Figure 6:
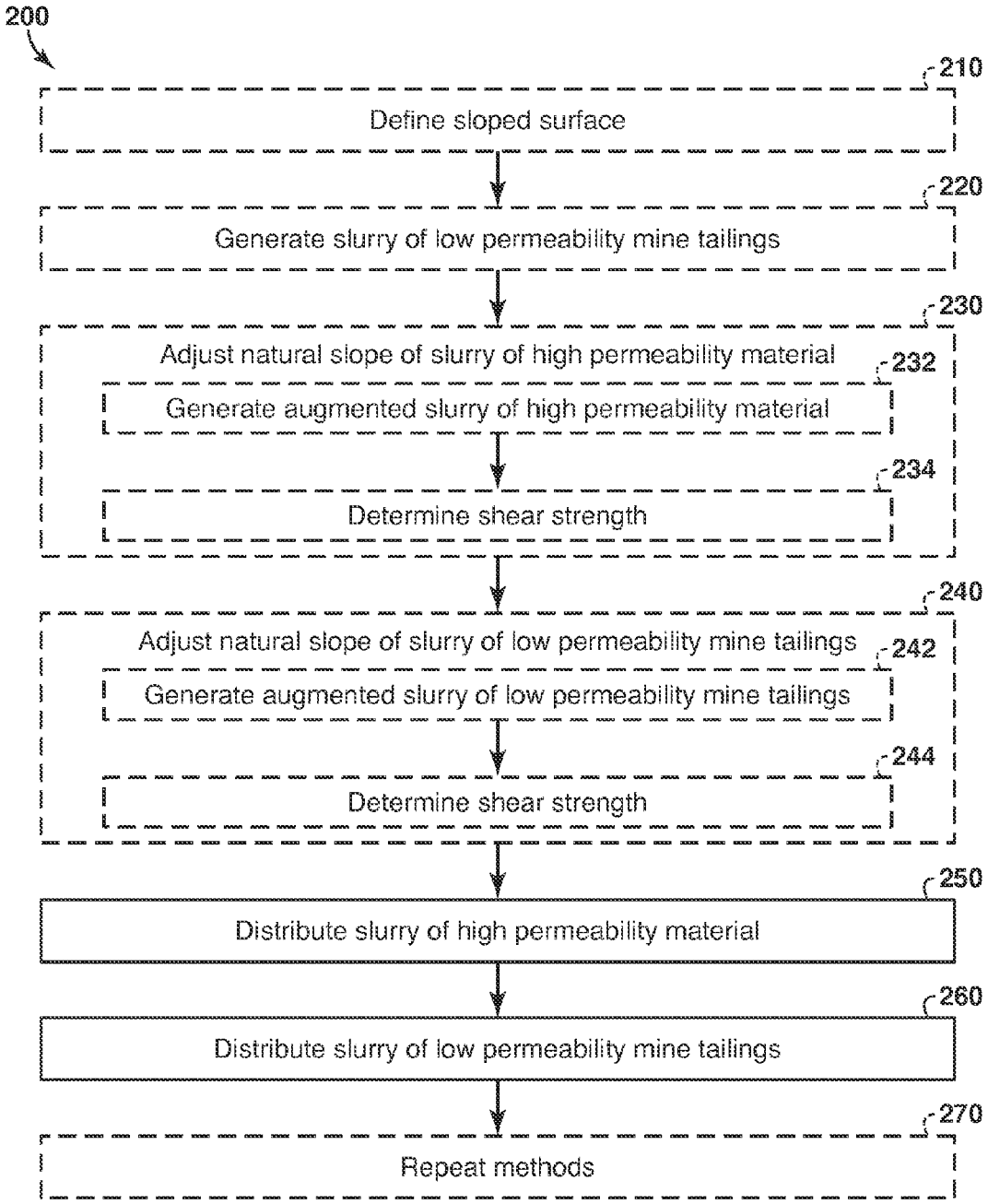
FIG. 6 is a flowchart depicting methods according to the present disclosure of dewatering mine tailings.

FIG. 6 is a flowchart depicting methods 200 according to the present disclosure of dewatering mine tailings, such as at a dewatering site. Methods 200 may include defining a sloped surface at 210, generating a slurry of low permeability mine tailings at 220, adjusting a natural slope of a slurry of high permeability material at 230, and/or adjusting a natural slope of a slurry of low permeability mine tailings at 240. Methods 200 include distributing the slurry of high permeability material at 250, distributing the slurry of the low permeability mine tailings at 260, and may include repeating the methods at 270.

Defining the sloped surface at 210 may include defining the sloped surface at the dewatering site. As an illustrative, non-exclusive example, the sloped surface may be defined by a substrate material that forms a berm and/or a dyke, and the defining the sloped surface at 210 may include distributing the substrate material. This may include flowing, grading, and/or otherwise locating the substrate material to define the sloped surface. Additionally or alternatively, the sloped surface may be defined by digging and/or excavating. Illustrative, non-exclusive examples of the substrate material according to the present disclosure include a permeable material, the high permeability material, the low permeability mine tailings, gravel, and/or sand.

The sloped surface may define a non-zero surface grade. Illustrative, non-exclusive examples of the surface grade of the sloped surface are discussed herein with reference to surface grade 112 of sloped surface 110.

Generating the slurry of low permeability mine tailings at 220 may include combining a mine tailings stream with a thickening agent, such as a flocculant, to generate the slurry of low permeability mine tailings. As an illustrative, non-exclusive example, this may include combining within a thickening assembly, such as thickening assembly 50 of FIG. 1. It is within the scope of the present disclosure that, subsequent to the generating at 220, methods 200 further may include pumping the slurry of low permeability mine tailings, such as to the dewatering site.

Adjusting the natural slope of the slurry of high permeability material at 230 may include adjusting, or decreasing, the natural slope of the high permeability material in any suitable manner. As illustrative, non-exclusive examples, the adjusting at 230 may include adjusting prior to the distributing at 250, adjusting during the distributing at 250, and/or adjusting while transferring the high permeability material to the mine tailings dewatering site. As another illustrative, non-exclusive example, the adjusting at 230 may include adjusting a shear strength of the slurry of high permeability material, increasing the shear strength of the slurry of high permeability material, and/or decreasing the shear strength of the slurry of high permeability material to adjust the natural slope of the slurry of high permeability material.

Additionally or alternatively, the adjusting at 230 also may include generating an augmented slurry of high permeability material at 232. The augmented slurry of high permeability material may have a smaller, or lower in magnitude, natural slope that the natural slope of the slurry of high permeability material and may be generated by combining the slurry of high permeability material with a high permeability material additive. Under these conditions, the distributing at 250 may include distributing the augmented slurry of high permeability material. Illustrative, non-exclusive examples of high permeability material additives, natural slopes of the slurry of high permeability material, and/or natural slopes of the augmented slurry of high permeability material are discussed herein.

Additionally or alternatively, the adjusting at 230 also may include determining, at 234, the shear strength of the slurry of high permeability material, the augmented slurry of high permeability material, the slurry of low permeability mine tailings, and/or the augmented slurry of low permeability mine tailings. This may include monitoring and/or detecting the shear strength and may be performed automatically, manually, and/or periodically.

When methods 200 include the determining at 234, the generating at 232 may include selecting a concentration and/or composition of the high permeability material additive within the augmented slurry of high permeability material based, at least in part, on the determined shear strength. As an illustrative, non-exclusive example, the generating at 232 may include increasing the concentration of the high permeability material additive within the augmented slurry of high permeability material to decrease the shear strength of the augmented slurry of high permeability material. The increasing may be responsive to determining that the shear strength of the slurry of high permeability material is greater than an upper high permeability shear strength threshold, responsive to determining that the shear strength of the augmented slurry of high permeability material is greater than an upper augmented high permeability shear strength threshold, responsive to determining that the shear strength of the slurry of low permeability mine tailings is less than a lower low permeability shear strength threshold, and/or responsive to determining that the shear strength of the augmented slurry of low permeability mine tailings is less than a lower augmented low permeability shear strength threshold.

As another illustrative, non-exclusive example, the generating at 232 additionally or alternatively may include decreasing the concentration of the high permeability material additive within the augmented slurry of high permeability material to increase the shear strength of the augmented slurry of high permeability material. The decreasing may be responsive to determining that the shear strength of the slurry of high permeability material is less than a lower high permeability shear strength threshold, responsive to determining that the shear strength of the augmented slurry of high permeability material is less than a lower augmented high permeability shear strength threshold, responsive to determining that the shear strength of the slurry of low permeability mine tailings is greater than an upper low permeability shear strength threshold, and/or responsive to determining that the shear strength of the augmented slurry of low permeability mine tailings is greater than an upper augmented low permeability shear strength threshold.

Adjusting the natural slope of the slurry of low permeability mine tailings at 240 may include adjusting, or increasing, the natural slope of the low permeability mine tailings in any suitable manner. As illustrative, non-exclusive examples, the adjusting at 240 may include adjusting prior to the distributing at 260, during the distributing at 260, and/or while transferring the slurry of low permeability mine tailings to the mine tailings dewatering site. As another illustrative, non-exclusive example, the adjusting at 230 may include adjusting a shear strength of the slurry of low permeability mine tailings, increasing the shear strength of the slurry of low permeability mine tailings, and/or decreasing the shear strength of the slurry of low permeability mine tailings to adjust the natural slope of the slurry of low permeability mine tailings.

Additionally or alternatively, the adjusting at 240 also may include generating an augmented slurry of low permeability mine tailings at 242. The augmented slurry of low permeability mine tailings may have a greater, or higher in magnitude, natural slope than the natural slope of the slurry of low permeability mine tailings and may be generated by combining the slurry of low permeability mine tailings with a low permeability mine tailings additive. When methods 200 include the generating at 242, the distributing at 260 may include distributing the augmented slurry of low permeability mine tailings. Illustrative, non-exclusive examples of low permeability mine tailings additives, natural slopes of the slurry of low permeability mine tailings, and/or natural slopes of the augmented slurry of low permeability mine tailings are discussed herein.

Additionally or alternatively, the adjusting at 240 also may include determining, at 244, the shear strength of the slurry of low permeability mine tailings, the augmented slurry of low permeability mine tailings, the slurry of high permeability material, and/or the augmented slurry of high permeability material. This may include monitoring and/or detecting the shear strength and may be performed automatically, manually, and/or periodically.

When methods 200 include the determining at 244, the generating at 242 may include selecting a concentration and/or composition of the low permeability mine tailings additive within the augmented slurry of low permeability mine tailings based, at least in part, on the determined shear strength. As an illustrative, non-exclusive example, the generating at 242 may include increasing the concentration of the low permeability mine tailings additive within the augmented slurry of low permeability mine tailings to increase the shear strength of the augmented slurry of low permeability mine tailings. The increasing may be responsive to determining that the shear strength of the slurry of low permeability mine tailings is less than the lower low permeability shear strength threshold, responsive to determining that the shear strength of the augmented slurry of low permeability mine tailings is less than the lower augmented low permeability shear strength threshold, responsive to determining that the shear strength of the slurry of high permeability material is greater than the upper high permeability shear strength threshold, and/or responsive to determining that the shear strength of the augmented slurry of high permeability material is greater than the upper augmented high permeability shear strength threshold.

As another illustrative, non-exclusive example, the generating at 242 may include decreasing the concentration of the low permeability mine tailings additive within the augmented slurry of low permeability mine tailings to decrease the shear strength of the augmented slurry of low permeability mine tailings. The decreasing may be responsive to determining that the shear strength of the slurry of low permeability mine tailings is greater than the upper low permeability shear strength threshold, responsive to determining that the shear strength of the augmented slurry of low permeability mine tailings is greater than the upper augmented low permeability shear strength threshold, responsive to determining that the shear strength of the slurry of high permeability material is less than the lower high permeability shear strength threshold, and/or responsive to determining that the shear strength of the augmented slurry of high permeability material is less than the lower augmented high permeability shear strength threshold.

Distributing the slurry of high permeability material at 250 may include distributing the slurry of high permeability material on the sloped surface in any suitable manner to form a high permeability layer on the sloped surface. As illustrative, non-exclusive examples, the distributing at 250 may include spreading, spraying, flowing, and/or hydraulically placing the slurry of high permeability material on the sloped surface. It is within the scope of the present disclosure that, as discussed in more detail herein, the slurry of high permeability material may be selected such that a natural slope of the slurry of high permeability material is within a threshold grade difference of the surface grade that is defined by the sloped surface. This may include generating an augmented slurry of high permeability material and distributing the augmented slurry of high permeability material on the sloped surface, as discussed herein with reference to the generating at 232.

As an illustrative, non-exclusive example, the distributing at 250 may include flowing the slurry of the high permeability material over and/or across the sloped surface and/or pumping the slurry of high permeability material to provide a motive force for the flowing. Additionally or alternatively, the flowing also may include flowing the slurry of high permeability material from a high permeability material discharge outlet and down the sloped surface under the influence of gravity.

It is within the scope of the present disclosure that, as discussed in more detail herein, the sloped surface may be defined by a berm and/or a dyke. Additionally or alternatively, the sloped surface also may have wicks, drains, and/or drainage pipe located therebelow. Additionally or alternatively, it is also within the scope of the present disclosure that the sloped surface by be defined by a previously formed and/or deposited layer, such as a low permeability layer, that was located on the berm and/or dyke prior to the distributing at 250. Thus, the distributing at 250 also may include flowing the slurry of high permeability material over and/or across and in contact with the previously formed low permeability layer.

Distributing the slurry of low permeability mine tailings at 260 may include distributing the slurry of low permeability mine tailings on the sloped surface in any suitable manner to form a low permeability layer on the sloped surface. As illustrative, non-exclusive examples, the distributing at 260 may include spreading, spraying, flowing, and/or hydraulically placing the slurry of low permeability mine tailings on the sloped surface. It is within the scope of the present disclosure that, as discussed in more detail herein, the slurry of low permeability mine tailings may be selected such that a natural slope of the slurry of low permeability mine tailings is within the threshold grade difference of the surface grade that is defined by the sloped surface. This may include generating an augmented slurry of low permeability mine tailings and distributing the augmented slurry of low permeability mine tailings on the sloped surface, as discussed herein with reference to the generating at 242.

As an illustrative, non-exclusive example, the distributing at 260 may include flowing the slurry of low permeability mine tailings vertically above and in physical contact with the high permeability layer that was formed during the distributing at 260. This may include flowing the slurry of low permeability mine tailings from a low permeability mine tailings discharge outlet and over the sloped surface under the influence of gravity.

As used herein, the terms "vertically above" and/or "vertically below" are relative terms that are intended to convey a relative orientation of two distinct layers. As an illustrative, non-exclusive example, a second layer may be present and/or located "vertically above" a first layer. As another illustrative, non-exclusive example, the first layer may be present and/or located "vertically below" the second layer. When the second layer is present and/or located "vertically above" the first layer, the second layer coats and/or otherwise covers at least a portion of the first layer (or an upper surface thereof). This may include coating and/or covering at least 50%, at least 60%, at least 70%, at least 80%, at least 90%, at least 95%, at least 99%, or 100% of the first layer (or the upper surface thereof).

As an illustrative, non-exclusive example, and prior to the second layer being located vertically above the first layer, the first layer may define an exposed upper surface. However, and subsequent to the second layer being located vertically above the first layer, the upper surface of the first layer may not be exposed, may be in contact with the second layer, and/or may form a portion of an interfacial region between the first layer and the second layer.

Generally, and when the second layer is "vertically above" the first layer, the first layer and the second layer are not coplanar and/or do not define a single, or continuous surface and/or contour. Instead, the two layers exist as parallel, or at least substantially parallel, layers. Thus, the second layer may not be an extension of the first layer, may not abut the first layer, and/or may not adjoin the first layer.

When the distributing at 250 includes flowing the slurry of high permeability material from the high permeability material discharge outlet and the distributing at 260 includes flowing the slurry of low permeability mine tailings from the low permeability mine tailings discharge outlet, methods 200 further may include decreasing a kinetic energy of the slurry of high permeability material prior to contact between the slurry of high permeability material and the low permeability layer. This may include locating the high permeability material discharge outlet at least a threshold distance uphill from the low permeability mine tailings discharge outlet.

As an illustrative, non-exclusive example, and when the distributing at 250 includes flowing the slurry of high permeability material over and/or above and in contact with the previously formed low permeability layer, the threshold distance between the high permeability material discharge outlet and the low permeability mine tailings outlet may define an energy dissipation region. The energy dissipation region may permit the slurry of high permeability material to dissipate kinetic energy before contact with the previously formed low permeability layer, thereby decreasing a potential for damage to and/or displacement of the previously formed low permeability layer by the slurry of high permeability material. Illustrative, non-exclusive examples of the threshold distance are discussed herein with reference to threshold distance 172.

The distributing at 260 also may include maintaining the high permeability layer intact, or at least substantially intact, while distributing the slurry of low permeability mine tailings thereon. As an illustrative, non-exclusive example, the maintaining may include distributing the slurry of low permeability mine tailings without mixing, or without substantial mixing, of the slurry of low permeability mine tailings with the high permeability layer. As another illustrative, non-exclusive example, the maintaining may include distributing the slurry of low permeability mine tailings without disturbing at least a threshold fraction of the high permeability layer. Illustrative, non-exclusive examples of threshold fractions according to the present disclosure include threshold fractions of at least 50%, at least 55%, at least 60%, at least 65%, at least 70%, at least 75%, at least 80%, at least 85%, at least 90%, at least 95%, at least 97.5%, or at least 99% of a volume of the high permeability layer.

Repeating the methods at 270 may include repeating any suitable portion of the methods to generate a plurality, or a plurality of interleaved, low permeability layers and high permeability layers. As an illustrative, non-exclusive example, the repeating at 270 may include repeating the distributing at 250 and subsequently repeating the distributing at 260 a plurality of times to generate the plurality of interleaved low permeability layers and high permeability layers. As another illustrative, non-exclusive example, the repeating at 270 also may include waiting at least a threshold dewatering time, as discussed herein, subsequent to defining a respective low permeability layer and prior to defining a high permeability layer that contacts the respective low permeability layer. When methods 200 include the repeating at 270, the slurry of high permeability material that forms each of the high permeability layers and/or the slurry of low permeability mine tailings that forms each of the low permeability layers that may have a natural slope that is within the threshold grade difference of the surface grade of the sloped surface, as discussed.

As yet another illustrative, non-exclusive example, the high permeability layer that is formed during the distributing at 250 may be a first high permeability layer, and the repeating at 270 may include repeating the distributing at 250 by distributing the slurry of high permeability material on the low permeability layer, which was formed during the distributing at 260, to form a second high permeability layer that is vertically above and may be in physical contact with the low permeability layer. As discussed, and when the distributing at 250 includes flowing the slurry of the high permeability material across the low permeability layer, the repeating also may include decreasing the kinetic energy of the slurry of high permeability material prior to contact between the slurry of high permeability material and the low permeability layer, such as through the use of an energy dissipation region. This may decrease a disturbance of the low permeability layer when the slurry of high permeability material is distributed thereacross.

As also discussed, methods 200 may include waiting a threshold dewatering time subsequent to the distributing at 260 and prior to repeating the distributing at 250. Illustrative, non-exclusive examples of threshold dewatering times are discussed herein.

As discussed, the repeating also may include forming a plurality of low permeability layers. As an illustrative, non-exclusive example, the low permeability layer that is formed during the distributing at 260 may be a first low permeability layer, and the repeating at 270 may include repeating the distributing at 260 by distributing the slurry of low permeability mine tailings on the second high permeability layer to form a second low permeability layer that is vertically above and may be in physical contact with the second high permeability layer.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

It is within the scope of the present disclosure that an individual step of a method recited herein, may additionally or alternatively be referred to as a "step for" performing the recited action.

INDUSTRIAL APPLICABILITY

The systems and methods disclosed herein are applicable to the oil and gas industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of dewatering mine tailings, the method comprising:

adjusting at least one of (i) a natural slope of a slurry of high permeability material and (ii) a natural slope of a slurry of low permeability mine tailings such that the natural slope of the slurry of high permeability material and the natural slope of the slurry of low permeability mine tailings are within a threshold grade difference of a non-zero surface grade that is defined by a sloped surface;

distributing the slurry of high permeability material on the sloped surface to define a high permeability layer; and distributing the slurry of low permeability mine tailings on the high permeability layer to define a low permeability layer, wherein a fluid permeability of the low permeability layer is less than a fluid permeability of the high permeability layer.

2. The method of claim 1, wherein the method comprises the adjusting the natural slope of the slurry of high permeability material, wherein the adjusting the natural slope of the slurry of high permeability material includes generating an augmented slurry of high permeability material by combining a high permeability material additive with the slurry of high permeability material such that a natural slope of the augmented slurry of high permeability material is less than the natural slope of the slurry of high permeability material, and wherein the distributing the slurry of high permeability material includes distributing the augmented slurry of high permeability material.

3. The method of claim 2, wherein the high permeability material additive includes at least one of a water soluble material, a water insoluble material, a polymer, a flocculant, a desiccant, a coagulant, anionic polyacrylamide, a dispersant, clay, thickened tailings, mature fine tailings, fluid fine tailings, the slurry of the low permeability mine tailings, a material that decreases the fluid permeability of the high permeability layer, and a material that increases the fluid permeability of the high permeability layer.

4. The method of claim 2, further comprises at least one of determining a shear strength of the augmented slurry of high permeability material and determining a shear strength of the slurry of low permeability mine tailings.

5. The method of claim 4, wherein the generating the augmented slurry of high permeability material includes at least one of:

(i) selecting a concentration for the high permeability material additive within the augmented slurry of high permeability material based, at least in part, on at least one of the shear strength of the augmented slurry of high permeability material and the shear strength of the slurry of low permeability mine tailings; and (ii) selecting a composition of the high permeability material additive based, at least in part, on at least one of the shear strength of the augmented slurry of high permeability material and the shear strength of the slurry of low permeability mine tailings.

6. The method of claim 5, further comprising at least one of:

(i) increasing the concentration of the high permeability material additive within the augmented slurry of high permeability material responsive to determining that the shear strength of the augmented slurry of high permeability material is greater than an upper augmented high permeability shear strength threshold;

(ii) decreasing the concentration of the high permeability material additive within the augmented slurry of high permeability material responsive to determining that the shear strength of the augmented slurry of high permeability material is less than a lower augmented high permeability shear strength threshold;

(iii) increasing the concentration of the high permeability material additive within the augmented slurry of high permeability material responsive to determining that the shear strength of the slurry of low permeability mine tailings is less than a lower low permeability shear strength threshold; and (iv) decreasing the concentration of the high permeability material additive within the augmented slurry of high permeability material responsive to determining that the shear strength of the slurry of low permeability mine tailings is greater than an upper low permeability shear strength threshold.

7. The method of claim 1, wherein the method comprises the adjusting the natural slope of the slurry of low permeability mine tailings, wherein the adjusting the natural slope of the slurry of low permeability mine tailings includes generating an augmented slurry of low permeability mine tailings by combining a low permeability mine tailings additive with the slurry of low permeability mine tailings such that a natural slope of the augmented slurry of low permeability mine tailings is greater than the natural slope of the slurry of low permeability mine tailings, and wherein the distributing the slurry of low permeability mine tailings includes distributing the augmented slurry of low permeability mine tailings.

8. The method of claim 7, wherein the low permeability mine tailings additive includes at least one of a water soluble material, a water insoluble material, a polymer, a flocculant, a desiccant, a coagulant, anionic polyacrylamide, and a material that increases the fluid permeability of the low permeability layer.

9. The method of claim 7, further comprising at least one of determining a shear strength of the augmented slurry of low permeability mine tailings and determining a shear strength of the slurry of high permeability material.

10. The method of claim 9, wherein the generating the augmented slurry of low permeability mine tailings includes at least one of:

(i) selecting a concentration for the low permeability mine tailings additive within the augmented slurry of low permeability mine tailings based, at least in part, on at least one of the shear strength of the augmented slurry of low permeability mine tailings and the shear strength of the slurry of high permeability material; and (ii) selecting a composition of the low permeability mine tailings additive based, at least in part, on at least one of the shear strength of the augmented slurry of low permeability mine tailings and the shear strength of the slurry of high permeability material.

11. The method of claim 10, further comprising at least one of:

(i) increasing the concentration of the low permeability mine tailings additive within the augmented slurry of low permeability mine tailings responsive to determining that the shear strength of the augmented slurry of low permeability mine tailings is less than a lower augmented low permeability shear strength threshold;

(ii) decreasing the concentration of the low permeability mine tailings additive within the augmented slurry of low permeability mine tailings responsive to determining that the shear strength of the augmented slurry of low permeability mine tailings is greater than an upper augmented low permeability shear strength threshold;

(iii) increasing the concentration of the low permeability mine tailings additive within the augmented slurry of low permeability mine tailings responsive to determining that the shear strength of the slurry of high permeability material is greater than an upper high permeability shear strength threshold; and (iv) decreasing the concentration of the low permeability mine tailings additive within the augmented slurry of low permeability mine tailings responsive to determining that the shear strength of the slurry of high permeability material is less than a lower high permeability shear strength threshold.

12. The method of claim 1, wherein the adjusting includes adjusting such that the threshold grade difference is less than 2% grade.

13. The method of claim 1, wherein the high permeability layer is a first high permeability layer, and wherein the method further comprises repeating the distributing the slurry of high permeability material on the low permeability layer to define a second high permeability layer that is vertically above the low permeability layer.

14. The method of claim 13, further comprising waiting a threshold dewatering time of at least 1 day subsequent to the distributing the slurry of low permeability mine tailings and prior to the repeating the distributing the slurry of high permeability material.

15. The method of claim 14, wherein the low permeability layer defines an exposed surface, wherein, subsequent to the threshold dewatering time, the low permeability layer defines a first region, which includes the exposed surface, and a second region, which is vertically below the first region, wherein a solids content of the first region is at least 40 wt %, wherein a solids content of the second region is less than 70 wt %, and further wherein the solids content of the first region is greater than the solids content of the second region.

16. The method claim 13, wherein the low permeability layer is a first low permeability layer, and wherein the method further comprises repeating the distributing the slurry of low permeability mine tailings on the second high permeability layer to define a second low permeability layer that is vertically above the second high permeability layer.

17. The method of claim 16, further comprising repeating the distributing the slurry of high permeability material and subsequently repeating the distributing the slurry of low permeability mine tailings a plurality of times to generate a plurality of interleaved low permeability layers and high permeability layers.

18. The method of claim 17, wherein the natural slope of the slurry of high permeability material that is utilized to form each of the plurality of high permeability layers is within the threshold grade difference of the surface grade, and further wherein the natural slope of the slurry of low permeability mine tailings that is utilized to form each of the plurality of low permeability layers is within the threshold grade difference of the surface grade.

19. The method of claim 1, wherein the distributing the slurry of low permeability mine tailings includes distributing without disturbing at least a threshold fraction of the high permeability layer, wherein the threshold fraction of the high permeability layer is at least 50% of the high permeability layer.

20. The method of claim 1, wherein the surface grade of the sloped surface is at least 1% and less than 5%.

21. The method of claim 1, wherein the distributing the slurry of high permeability material includes flowing the slurry of high permeability material over the sloped surface.

22. The method of claim 1, wherein the distributing the slurry of low permeability mine tailings includes flowing the slurry of low permeability mine tailings over the high permeability layer.

23. The method of claim 22, wherein the flowing the slurry of low permeability mine tailings includes flowing vertically above and in physical contact with the high permeability layer from a low permeability mine tailings discharge outlet and over the sloped surface under the influence of gravity.

24. The method of claim 23, further comprising locating a high permeability material discharge outlet at least a threshold distance uphill from the low permeability mine tailings discharge outlet to define an energy dissipation region.

25. A method of dewatering mine tailings, the method comprising:

distributing a slurry of high permeability material on a sloped surface to define a high permeability layer, wherein the sloped surface defines a non-zero surface grade, and further wherein a natural slope of the slurry of high permeability material is within a threshold grade difference of the surface grade, wherein the threshold grade difference is less than 2% grade; and distributing a slurry of low permeability mine tailings on the high permeability layer to define a low permeability layer, wherein a fluid permeability of the low permeability layer is less than a fluid permeability of the high permeability layer, and further wherein a natural slope of the low permeability mine tailings is with the threshold grade difference of the surface grade.

26. A mine tailings dewatering site, comprising:

a sloped surface that defines a non-zero surface grade;

a plurality of spaced-apart high permeability layers formed from a high permeability material, wherein each of the plurality of spaced-apart high permeability layers is supported by and at least substantially parallel to the sloped surface; and a plurality of low permeability layers formed from low permeability mine tailings, wherein each of the plurality of low permeability layers is supported by and at least substantially parallel to the sloped surface, and further wherein at least one low permeability layer of the plurality of low permeability layers is located between and physically separates each high permeability layer of the plurality of spaced-apart high plurality layers from a remainder of the plurality of high permeability layers.

27. The dewatering site of claim 26, wherein at least one of the plurality of high permeability layers includes a high permeability material additive that is selected to change a shear strength of a slurry of high permeability material that forms the plurality of high permeability layers.

28. The dewatering site of claim 26, wherein at least one of the plurality of low permeability layers includes a low permeability mine tailings additive that is selected to change a shear strength of the low permeability mine tailings that form the plurality of low permeability layers.

29. The dewatering site of claim 26, wherein the plurality of high permeability layers defines an average high permeability layer thickness of at least 20 cm, and further wherein the plurality of low permeability layers defines an average low permeability layer thickness of at least 20 cm.

30. The dewatering site of claim 26, wherein each of the plurality of high permeability layers and each of the plurality of low permeability layers defines a layer length, and further wherein the layer length is at least 100 meters.

31. The dewatering site of claim 26, wherein the surface grade of the sloped surface is at least 2% and less than 4%.

32. The dewatering site of claim 26, wherein the high permeability material includes at least one of high permeability mine tailings, sand, and coarse sand tailings.

33. The dewatering site of claim 26, wherein the low permeability mine tailings include at least one of thickened tailings (TT), mature fine tailings (MFT), solvent recovery unit tailings (TSRU), and fluid fine tailings (FFT).

34. The dewatering site of claim 26, wherein each of the plurality of spaced-apart high permeability layers is located on the sloped surface by flowing a slurry of the high permeability material thereacross and in contact with a respective low permeability layer of the plurality of low permeability layers, wherein the plurality of low permeability layers is located on the sloped surface by flowing a slurry of the low permeability mine tailings thereacross and in contact with a respective high permeability layer of the plurality of high permeability layers, and further wherein the dewatering site includes an energy dissipation region that is configured to decrease a kinetic energy of the slurry of high permeability material prior to contact with the respective low permeability layer.

* * * * *